US012285109B2

(12) United States Patent
Chen

(10) Patent No.: US 12,285,109 B2
(45) Date of Patent: Apr. 29, 2025

(54) POSITIONER OF CHAIR ADJUSTING DEVICE

(71) Applicant: Hsin-Hua Chen, Kaohsiung (TW)

(72) Inventor: Hsin-Hua Chen, Kaohsiung (TW)

( * ) Notice: Subject to any disclaimer, the term of this patent is extended or adjusted under 35 U.S.C. 154(b) by 118 days.

(21) Appl. No.: 18/129,092

(22) Filed: Mar. 31, 2023

(65) Prior Publication Data

US 2024/0277146 A1 Aug. 22, 2024

(30) Foreign Application Priority Data

Feb. 22, 2023 (TW) ..... 112201581

(51) Int. Cl.
*A47C 1/026* (2006.01)
*A47C 1/032* (2006.01)
*A47C 3/26* (2006.01)

(52) U.S. Cl.
CPC ..... *A47C 1/026* (2013.01); *A47C 1/03238* (2013.01); *A47C 3/26* (2013.01)

(58) Field of Classification Search
CPC ..... A47C 1/026; A47C 3/26; A47C 1/025; A47C 1/03238
See application file for complete search history.

(56) References Cited

U.S. PATENT DOCUMENTS 8,567,601 B2 * 10/2013 Turek ..... E04D 1/30 206/505
2005/0077766 A1 * 4/2005 Chen ..... A47C 1/026 297/300.8
2006/0162262 A1 * 7/2006 Smith ..... E04B 1/34342 52/58
2016/0008731 A1 * 1/2016 Thompson ..... B41F 17/24 347/213

FOREIGN PATENT DOCUMENTS

| | | | | |
|---|---|---|---|---|
| CN | 205911850 U | * | 1/2017 | |
| DE | 102010055529 A1 | * | 6/2012 | ..... A47C 1/026 |
| JP | 2005351182 A | * | 12/2005 | |
| JP | 4255155 B2 | * | 4/2009 | |
| JP | 2009095203 A | * | 4/2009 | |
| KR | 101028731 B1 | * | 4/2011 | |
| WO | WO-2012067043 A1 | * | 5/2012 | ..... H02K 1/276 |

* cited by examiner

*Primary Examiner* — Timothy J Brindley
(74) *Attorney, Agent, or Firm* — Leong C. Lei

(57) ABSTRACT

A positioner of a chair adjusting device is disclosed. The positioner is formed by stacking a plurality of positioning plates together. Each of the positioning plates is formed with a positioning section, a combination section, and a penetration section. The combination section is formed of a recessed cavity recessed from one surface and a projecting peg projecting from an opposite surface, and an outside diameter of the projecting peg corresponds to an inside diameter of the recessed cavity, so that for two of the positioning plates that are stacked together to be respectively on an upper side and a lower side, the projecting peg of the positioning plate on the upper side is receivable into and fit in the recessed cavity of the positioning plate on the lower side to have the two positioning plates that are stacked together on the upper and lower sides combined together through tight fitting.

3 Claims, 5 Drawing Sheets

POSITIONER OF CHAIR ADJUSTING DEVICE

TECHNICAL FIELD OF THE INVENTION

The present invention relates generally to a positioner of a chair adjusting device, and more particularly to a positioner of a chair adjusting device that helps simplify the operation of assembling of the positioner so as to reduce the cost of the chair adjusting device.

DESCRIPTION OF THE PRIOR ART

As shown in FIG. 1, To enhance comfortably of sitting on a chair 1, an adjusting device 2 for adjusting elevation of the chair 1 is often provided on an underside of a seat cushion 11 of the chair 1.

As shown in FIGS. 1 and 2, the adjusting device 2 at least comprises a positioner 21 for setting an adjusted angle. The positioner 21 is provided, on one side thereof, with a plurality of positioning troughs 211 for engagement for positioning. The positioner 21 is formed of a plurality of positioning plates 21*a* that are formed through stamping and stacked together. Specifically, each piece of the positioning plates 21*a* is stamped such that one side is formed, through stamping, with the positioning troughs 211, and the other side opposite to the positioning troughs 211 is formed, through stamping, with combination through-holes 212. Generally, two such combination through-holes 212 are provided. The positioner 21 is assembled in such a way that the plurality of positioning plates 21*a* are stacked and are constrained by a jig to have fastening elements 22 to penetrate through two combination through-hole 212. The fastening elements 22 are generally implemented as rivets, namely the fastening elements 22 (rivets) are applied to combine the plurality of positioning plates 21*a* together to form a positioner 21 having a form of a block. The positioner 21 is made by an operator stacking the positioning plates 21*a* piece by piece and then applying the fastening elements 22 to rivet the plurality of positioning plates 21*a* together to form a block, and consequently, the fabrication process of the positioner 21 is complicated and tedious and the labor cost is greatly increased, and also, errors easily occur during riveting.

Thus, it is a challenge of the chair manufacturers to provide a positioner of a chair adjusting device that effectively reduces the fabrication cost of the positioner.

SUMMARY OF THE INVENTION

The primary objective of the present invention is to provide a positioner of a chair adjusting device, which helps overcome the defect of the prior art positioner in respect of the operation of assembling being complicated and tedious that leads to an excessively high fabrication cost of the positioner.

The primary technical solution of the present invention provides a positioner of a chair adjusting device, wherein the positioner is formed by stacking a plurality of positioning plates together; each individual piece of the positioning plates is formed with a positioning section, a combination section, and a penetration section; the combination section is formed of a recessed cavity recessed from one surface and a projecting peg projecting from an opposite surface, an outside diameter of the projecting peg corresponding to an inside diameter of the recessed cavity, so that for two of the positioning plates that are stacked together to be respectively on an upper side and a lower side, the projecting peg of the positioning plate on the upper side is receivable into and fit in the recessed cavity of the positioning plate on the lower side to have the two positioning plates that are stacked together on the upper and lower sides combined together through tight fitting.

The efficacy that the present invention may achieve by means of the primary technical solution is that the operation of assembling of the positioner can be simplified so as to reduce the cost of the chair adjusting device.

DETAILED DESCRIPTION OF THE PREFERRED EMBODIMENT

Figure 1:
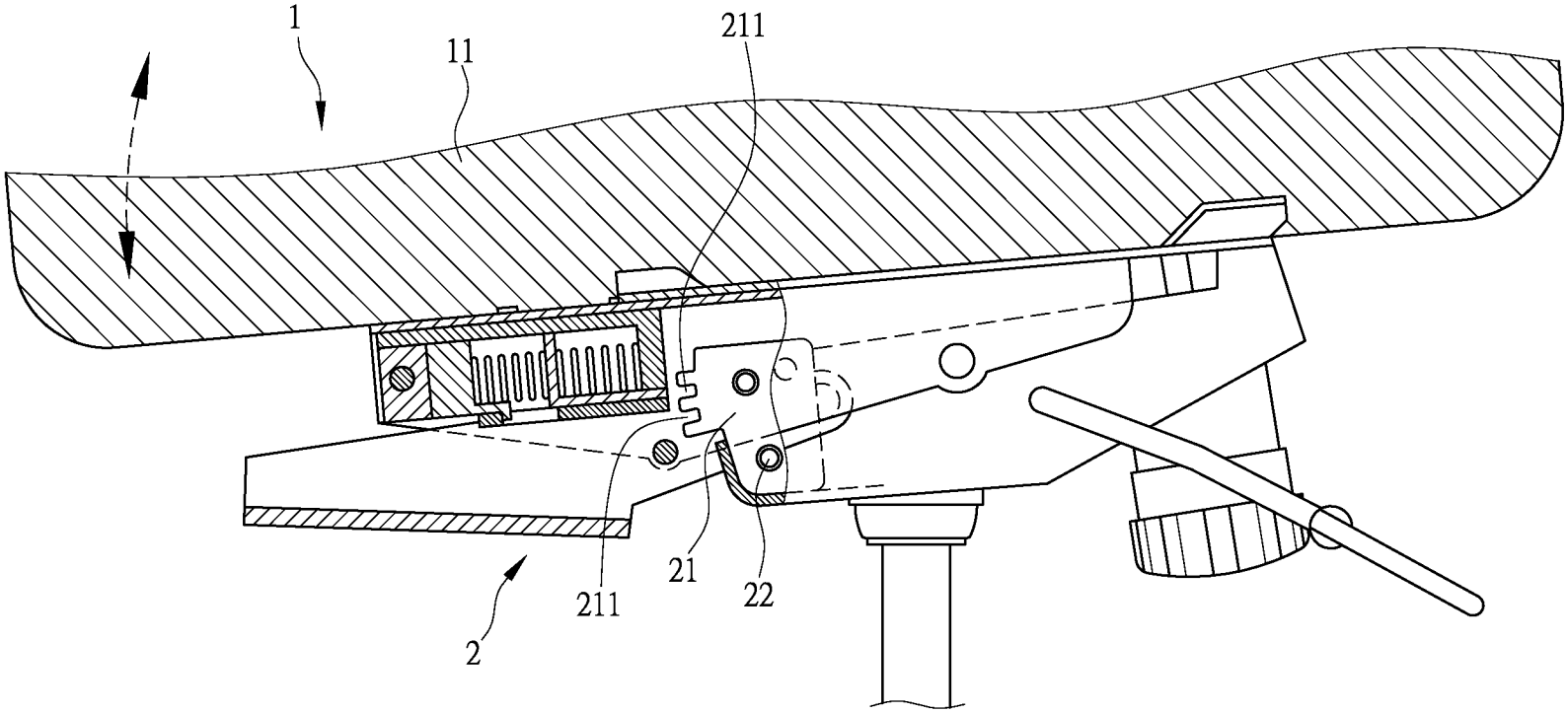
PRIOR ART FIG. 1
FIG. 1 is a schematic view showing arrangement of a prior art positioner of a chair adjusting device the positioner.
Figure 2:
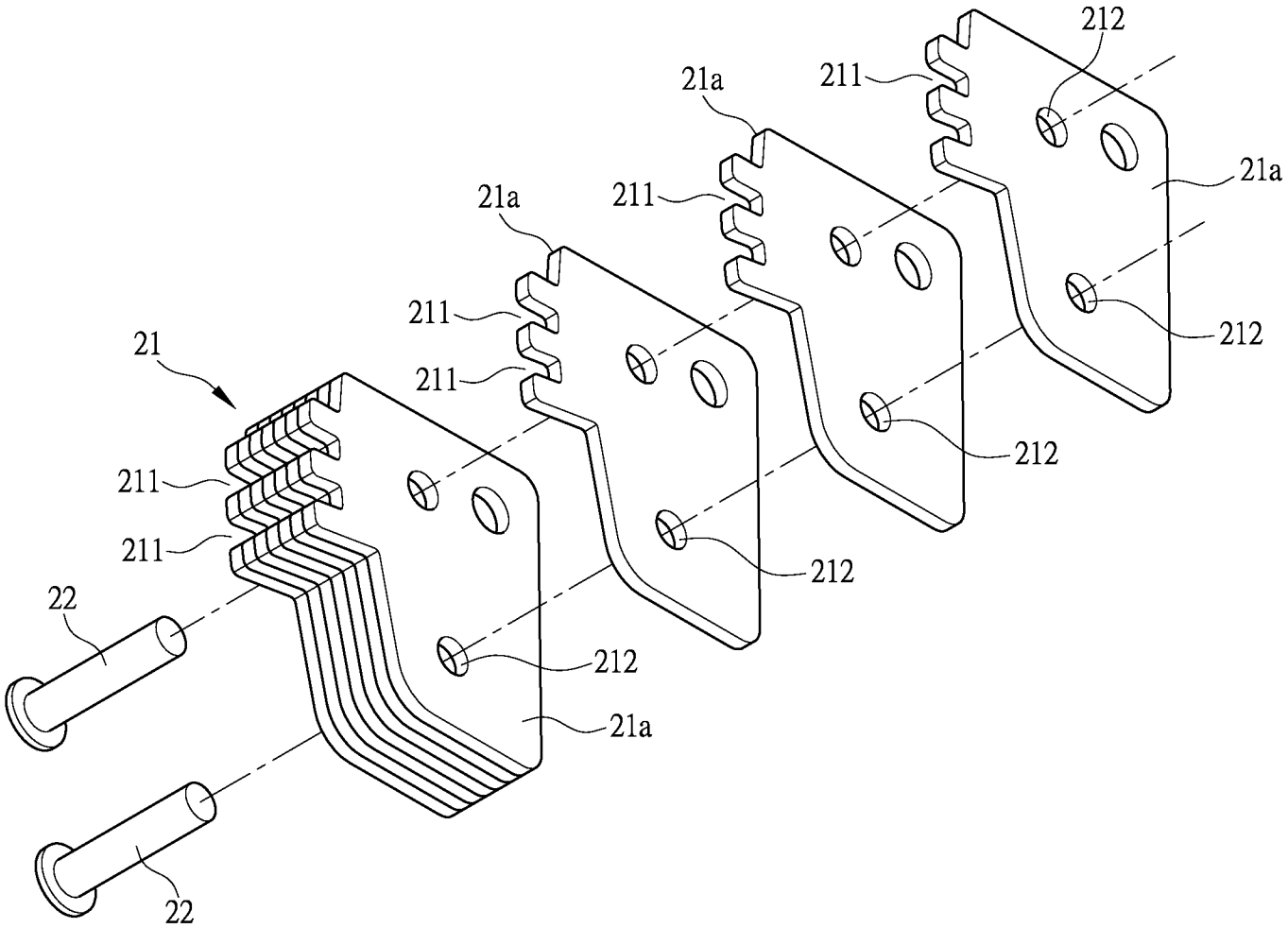
PRIOR ART FIG. 2
FIG. 2 is a schematic view showing assembling of the prior art positioner.
Figure 3:
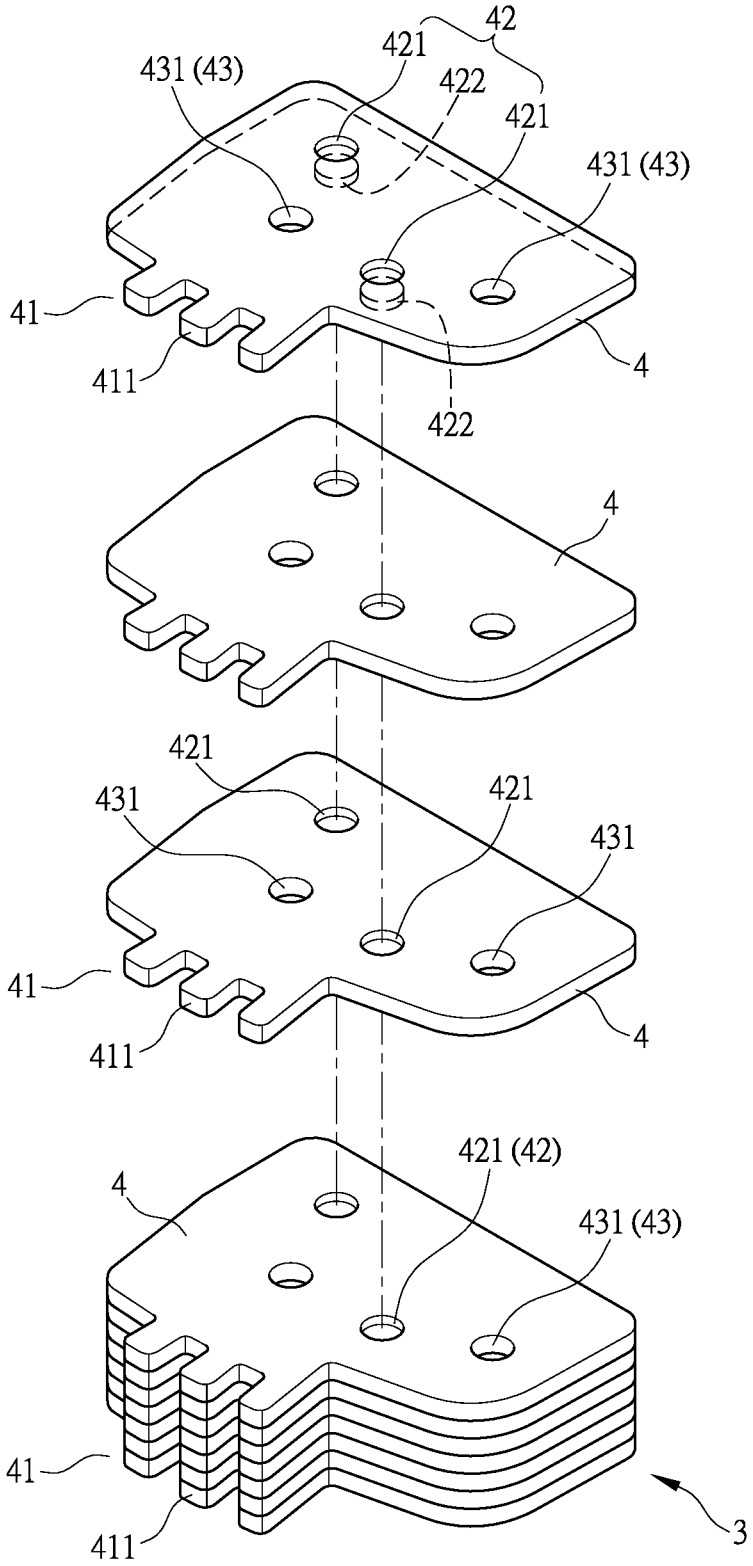
FIG. 3 is an exploded view showing a positioner according to the present invention

For better understanding of the structure of the present invention, and also the efficacy that can be achieved thereby, a description will be provided below with reference to the attached drawings:

Referring firstly to FIG. 3, the present invention provides a positioner of a chair adjusting device. The positioner 3 is formed by stacking a plurality of positioning plates 4.

Figure 4:
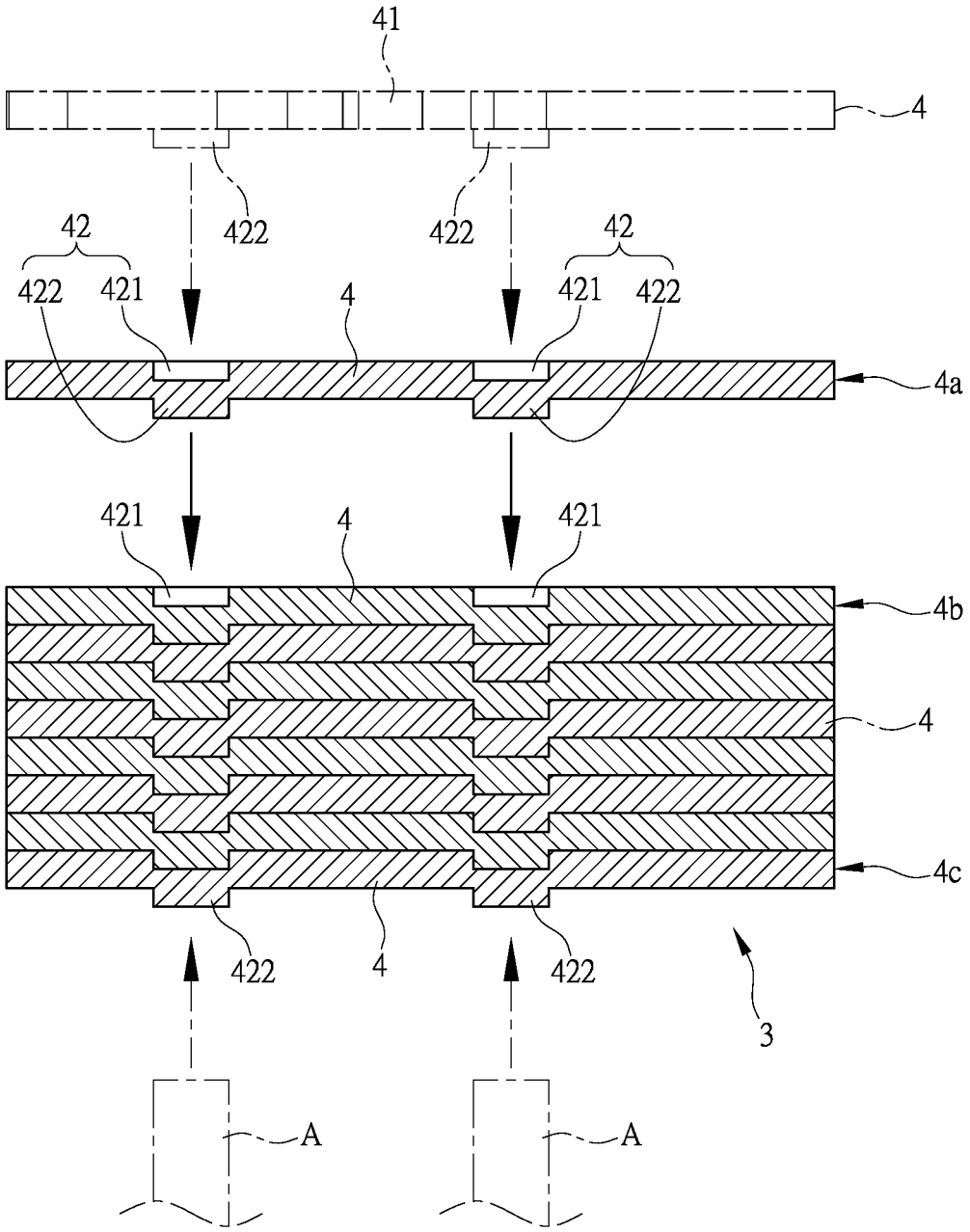
FIGS. 4 and 5 are schematic views showing operation of assembling of the positioner according to the present invention.

As shown in FIGS. 3 and 4, the positioning plates 4 are plates formed through die stamping. The positioning plates 4, when being made in a plate form by means of die stamping, is also being stamped to form a positioning section 41 on an edge of one side thereof and a combination section 42 and a penetration section 43 at an opposite side.

As shown in FIGS. 3 and 4, the positioning section 41 is formed of a plurality of positioning teeth 411 in a corrugated form.

As shown in FIGS. 3 and 4, the combination section 42 is formed of a recessed cavity 421 formed by recessing one surface and a projecting peg 422 formed to project from an opposite surface, and an outside diameter of the projecting peg 422 corresponds to an inside diameter of the recessed cavity 421, so that two of the positioning plates 4 that are stacked on upper and lower sides are such that the projecting peg 422 of the upper-side positioning plate 4*a* is receivable into and fit in the recessed cavity 421 of the lower-side positioning plates 4*b* to have the two positioning plates 4 stacked on the upper and lower sides to be combined together in a tight fitting manner. In the present invention, an arrangement of two combination sections 42 is taken as an example for illustration.

As shown in FIG. 3, the penetration section 43 is formed of a through hole 431, and in the present invention, an arrangement of two such through holes 431 are taken as example for illustration of the penetration section 43.

Figure 5:
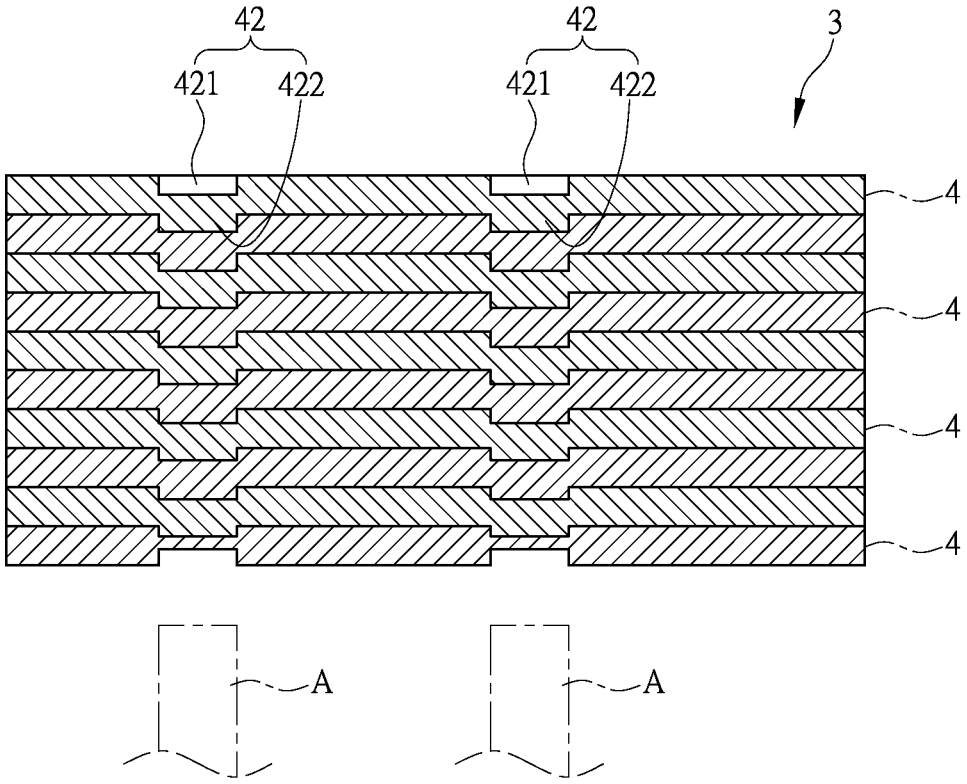

As shown in FIGS. 3, 4, and 5, one way of assembling the positioner 3 according to the present invention is such that die stamping is applied to form an individual piece of the positioning plates 4 that is made in the form of plate including a positioning section 41, a combination section 42, and a penetration section 43; an automatized operation is conducted to automatically move the individual piece of the positioning plates 4 that is stamped with the positioning section 41, the combination section 42, and the penetration section 43 to stack at a site of a combination stamping die, so that one individual piece of the positioning plates 4 is stacked on another one individual piece of the positioning plates 4 and are subjected to stamping to combine together, namely the projecting peg 422 of the upper-side positioning plate 4*a* is fit, by means of the stamping force, into the recessed cavity 421 of the lower-side positioning plate 4*b* to have the two positioning plates 4*a*, 4*b* stacked on each other at the upper and lower sides to combine together through tight fitting therebetween; and as such, a further piece of the positioning plates 4 is then stacked and subsequent subjected to stamping for combination, and when the plurality of positioning plates 4 are combined, through stamping, to show a preset thickness, a stamping pillar A is applied to press on the projecting peg 422 of a lowermost positioning plate 4*c* to force the projecting peg 422 of the lowermost positioning plate 4*c* to shrink inward in the upward direction thereby making the portion of the lowermost positioning plate 4*c* on which the projecting peg 422 is located inwardly recessed, namely the surface of the lowermost positioning plate 4*c* where the projecting peg 422 is located is set in a condition of being slightly flat without projecting therefrom, and this completes the assembling of the positioner 3. It is noted that when the projecting peg 422 of the lowermost positioning plate 4*c* is being stamped to shrink inward in the upward direction, all the positioning plates 4 that are located above the lowermost positioning plate 4*c* can absorb, in a progressively reducing manner, the amount of inward shrinkage of the projecting peg 422 of the lowermost positioning plate 4*c*.

The efficacy of the present invention is that the positioner 3 is formed by stacking a plurality of positioning plates 4 together; each individual piece of the positioning plates 4 is formed with a positioning section 41, a combination section 42, and a penetration section 43; the combination section 42 is formed of a recessed cavity 421 recessed from one surface and a projecting peg 422 projecting from an opposite surface, an outside diameter of the projecting peg 422 corresponding to an inside diameter of the recessed cavity 421, so that for two of the positioning plates 4 that are stacked together to be respectively on an upper side and a lower side, the projecting peg 422 of the positioning plate 4*a* on the upper side is receivable into and fit in the recessed cavity 421 of the positioning plate 4*b* on the lower side to have the two positioning plates 4 that are stacked together on the upper and lower sides combined together through tight fitting. As such, the operation of assembling of the positioner 3 is simplified, so as to reduce the cost of the chair adjusting device.

I claim:

1. A positioner of a chair adjusting device, wherein the positioner is formed by stacking a plurality of positioning plates together; each individual piece of the positioning plates is formed with a positioning section, a combination section, and a penetration section; the combination section is formed of a recessed cavity recessed from one surface and a projecting peg projecting from an opposite surface, an outside diameter of the projecting peg corresponding to an inside diameter of the recessed cavity, so that for two of the positioning plates that are stacked together to be respectively on an upper side and a lower side, the projecting peg of the positioning plate on the upper side is receivable into and fit in the recessed cavity of the positioning plate on the lower side to have the two positioning plates that are stacked together on the upper and lower sides combined together through tight fitting, wherein the plurality of positioning plates comprise a lowermost positioning plate and multiple positioning plates sequentially stacked on the lowermost positioning plate in an upward direction, wherein the projecting peg of the lowermost positioning plate is pressed in the upward direction with a stamping pillar so as to cause inward shrinkage of the projecting peg of the lowermost positioning plate in the upward direction, and the multiple positioning plates stacked on the lowermost positioning plate absorb, in a progressively reducing manner, an amount of the inward shrinkage of the projecting peg of the lowermost positioning plate.

2. The positioner of the chair adjusting device according to claim 1, wherein the positioning section comprises a plurality of positioning teeth.

3. The positioner of the chair adjusting device according to claim 1, wherein the penetration section comprises a number of through holes and the number of the through holes is two.

* * * * *